US009958819B2

(12) United States Patent
Uchiyama

(10) Patent No.: US 9,958,819 B2
(45) Date of Patent: May 1, 2018

(54) FUSING APPARATUS AND MANUFACTURING METHOD THEREFOR

(71) Applicant: BROTHER KOGYO KABUSHIKI KAISHA, Nagoya-shi, Aichi-ken (JP)

(72) Inventor: Yuta Uchiyama, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/627,784

(22) Filed: Jun. 20, 2017

(65) Prior Publication Data

US 2018/0095388 A1 Apr. 5, 2018

(30) Foreign Application Priority Data

Sep. 30, 2016 (JP) ..... 2016-193968

(51) Int. Cl.
*G03G 15/20* (2006.01)

(52) U.S. Cl.
CPC ..... *G03G 15/2053* (2013.01); *G03G 15/2089* (2013.01); *G03G 2215/2035* (2013.01)

(58) Field of Classification Search
CPC ..... G03G 15/2053; G03G 15/2064; G03G 15/2089; G03G 2215/2016; G03G 2215/2035
See application file for complete search history.

(56) References Cited

U.S. PATENT DOCUMENTS

| | | | | |
|---|---|---|---|---|
| 7,142,803 | B2 * | 11/2006 | Koyama | G03G 15/206 399/329 |
| 8,280,291 | B2 * | 10/2012 | Yamamoto | G03G 15/657 399/329 |
| 2010/0202809 | A1 | 8/2010 | Shinshi et al. | |
| 2010/0290823 | A1 | 11/2010 | Okabe et al. | |
| 2010/0296849 | A1 | 11/2010 | Yamamoto | |
| 2011/0076071 | A1 | 3/2011 | Yamaguchi et al. | |
| 2013/0164058 | A1 | 6/2013 | Suzuki et al. | |
| 2015/0261155 | A1 | 9/2015 | Yoshiura et al. | |

FOREIGN PATENT DOCUMENTS

| | | | |
|---|---|---|---|
| JP | 2009-86391 | A | 4/2009 |
| JP | 2010-181821 | A | 8/2010 |
| JP | 2010-266802 | A | 11/2010 |
| JP | 2010-271623 | A | 12/2010 |

(Continued)

*Primary Examiner* — Hoang Ngo
(74) *Attorney, Agent, or Firm* — Merchant & Gould P.C.

(57) ABSTRACT

A fusing apparatus, including a base member, a sheet member, a fixing portion, and an endless member, is provided. The sheet member includes a contact portion to contact an inner peripheral surface of the endless member, a first portion having a first hole, and a second portion to be fixed to the base member. The base member includes a first face to support the contact portion, a second face, and an inner face recessed from the second face to form a recessed portion. The fixing portion includes a first engagement portion protruding from the inner face of the recessed portion to be engageable with the first hole, and a holder provided at the first engagement portion to hold a peripheral portion around the first hole in the first portion of the sheet member at a position between the inner face of the recessed portion and the holder.

20 Claims, 8 Drawing Sheets

(56) References Cited

FOREIGN PATENT DOCUMENTS

| | | | |
|---|---|---|---|
| JP | 2011-70070 | A | 4/2011 |
| JP | 2012-145633 | A | 8/2012 |
| JP | 2013-152435 | A | 8/2013 |
| JP | 2014-145858 | A | 8/2014 |
| JP | 2016-33636 | A | 3/2016 |

* cited by examiner

FUSING APPARATUS AND MANUFACTURING METHOD THEREFOR

CROSS REFERENCE TO RELATED APPLICATION

This application claims priority from Japanese Patent Application No. 2016-193968, filed on Sep. 30, 2016, the entire subject matter of which is incorporated herein by reference.

BACKGROUND

Technical Field

An aspect of the present disclosure is related to a fusing apparatus to thermally fix a toner image on a sheet and a method to manufacturing the fuser device.

Related Art

A fusing apparatus having a fuser roller, a pressurizer belt, a pressure pad arranged on an inner side of the pressurizer belt to urge the pressurizer belt against the fuser roller, and a low-friction sheet arranged between the pressure pad and the pressurizer belt, is known. The low-friction sheet may be fixed immovably to the pressure pad at one end thereof but may be free to be movable at the other end thereof.

SUMMARY

In this known arrangement of the low-friction sheet in the fusing apparatus, while the low-friction sheet may be restrained from moving solely at the one end thereof, a position of the low-friction sheet within the fusing apparatus may be unstable. For example, the low-friction sheet may be displaced from a correct position or may be loosened to be deformed.

The present disclosure is advantageous in that a fusing apparatus, in which a low-friction sheet may be restrained from being displaced or deformed, is provided.

According to an aspect of the present disclosure, a fusing apparatus, including a base member, a sheet member wrapped around the base member, a fixing member fixing the sheet member to the base member, and an endless belt looped around the base member and the sheet member, is provided. The endless belt includes an inner peripheral surface arranged to be in contact with the sheet member. The sheet member includes a contact portion including a contacting surface, on which the inner peripheral surface of the endless belt contacts the sheet member, and an opposite surface, which is on a side opposite to the contacting surface; a first portion extending from a first end of the contact portion and including an inner edge that outlines a first hole; and a second portion extending from a second end of the contact portion to be fixed to the base member. The base member includes a first face supporting the opposite surface of the contact portion of the sheet member; a second face being a different face from the first face; and an inner face recessed from the second face to form a recessed portion, in which a peripheral portion around the first hole formed in the first portion of the sheet member is set. The fixing member including a first engagement portion, which protrudes from the inner face of the recessed portion of the base member and is engageable with the inner edge of the first hole; and a holder, which is provided at the first engagement portion and is configured to hold the peripheral portion around the first hole in the first portion of the sheet member at a position between the inner face of the recessed portion of the base member and the holder.

According to another aspect of the present disclosure, a fusing apparatus, including a base member, a sheet member wrapped around the base member, an endless belt looped around the base member and the sheet member, is provided. The endless belt includes an inner peripheral surface arranged to be in contact with the sheet member. The sheet member includes a contact portion including a contacting surface, on which the inner peripheral surface of the endless belt contacts the sheet member, and an opposite surface, which is on a side opposite to the contacting surface; a first portion extending from a first end of the contact portion and including an inner edge that outlines a first hole; and a second portion extending from a second end of the contact portion to be fixed to the base member. The base member includes a first face supporting the opposite surface of the contact portion of the sheet member; a second face being a different face from the first face; and an inner face recessed from the second face to form a recessed portion, in which a peripheral portion around the first hole formed in the first portion of the sheet member is set; and the fixing portion fixing the sheet member to the base member. The fixing portion includes a first engagement portion, which protrudes from the inner face of the recessed portion of the base member and is engageable with the inner edge of the first hole; and a holder, which is provided at the first engagement portion and is configured to hold the peripheral portion around the first hole in the first portion of the sheet member at a position between the inner face of the recessed portion of the base member and the holder.

According to still an aspect of the present disclosure, a fusing apparatus, including a base member, a sheet member wrapped around the base member, a fixing portion fixing the sheet member to the base member, and an endless member looped around the base member and the sheet member, is provided. The endless member includes an inner peripheral surface arranged to be in contact with the sheet member. The sheet member includes a contact portion, on which the inner peripheral surface of the endless member contacts the sheet member, a first portion extending from a first end of the contact portion and having an inner edge that outlines a first hole, and a second portion extending from a second end of the contact portion to be fixed to the base member. The base member includes a first face supporting the contact portion of the sheet member, a second face being a different face from the first face, and an inner face recessed from the second face to form a recessed portion, in which a peripheral portion around the first hole formed in the first portion of the sheet member is set. The fixing portion includes a first engagement portion, which protrudes from the inner face of the recessed portion of the base member and is engageable with the inner edge of the first hole; and a holder, which is provided at the first engagement portion and is configured to hold the peripheral portion around the first hole in the first portion of the sheet member at a position between the inner face of the recessed portion of the base member and the holder.

BRIEF DESCRIPTION OF THE ACCOMPANYING DRAWINGS

DETAILED DESCRIPTION

Hereinafter, an embodiment of the present disclosure will be described with reference to the accompanying drawings. In the following description, directions related to a laser printer 1 will be cited on the basis of orientation indicated by arrows in FIG. 1. For example, a term "vertical direction" may denote an up-to-down or down-to-up direction in FIG. 1; and a viewer's right-hand side, left-hand side, nearer side, and farther side in FIG. 1 may be referred to as front, rear, left, and right, respectively. A front-to-rear or rear-to-front direction may be referred to as a front-rear direction, and a right-to-left or left-to-right direction may be referred to as a widthwise direction.

Figure 1:
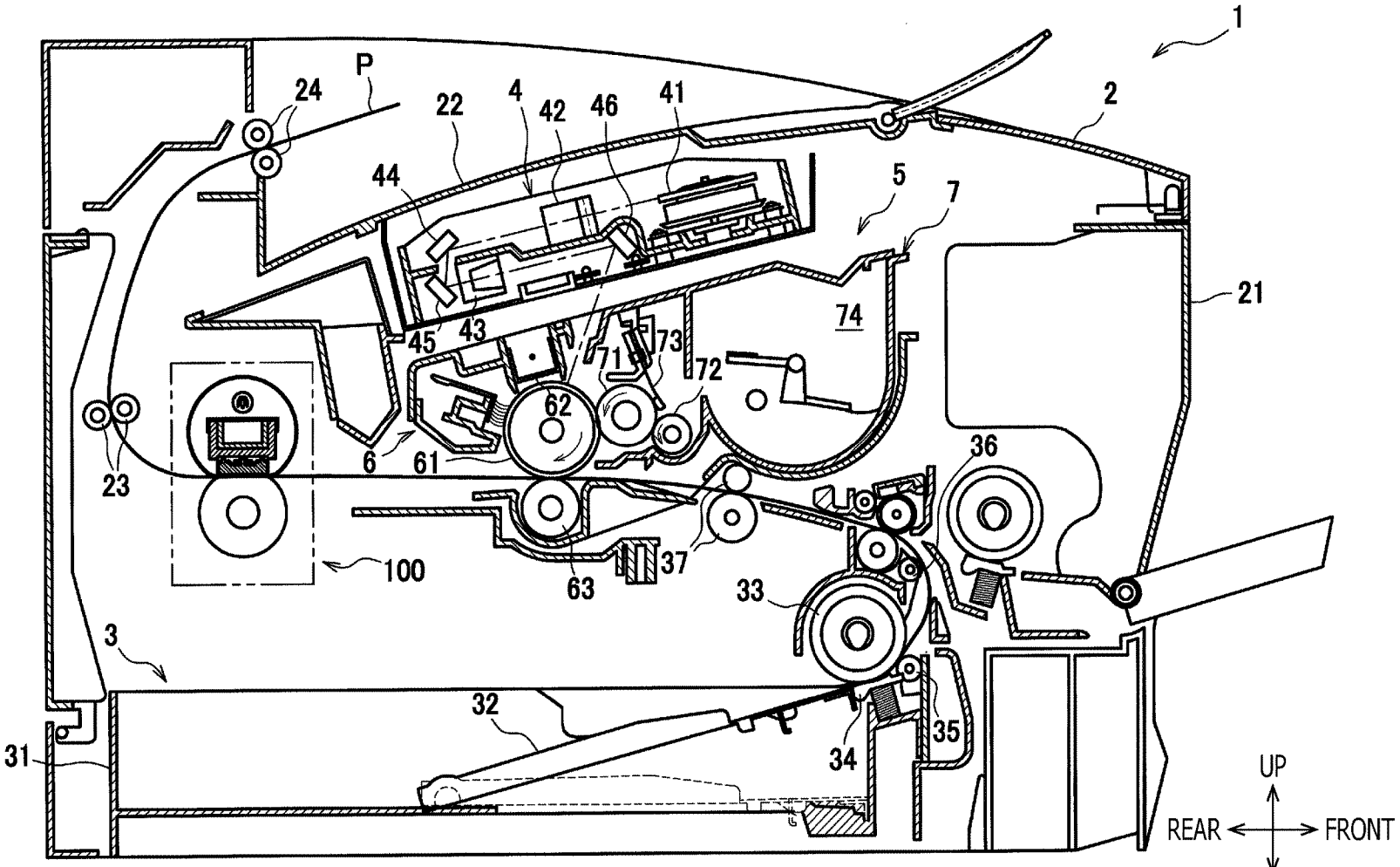
FIG. 1 is a cross-sectional view of a laser printer having a fuser according to an embodiment of the present disclosure.

As shown in FIG. 1, the laser printer 1 includes a sheet feeder 3, an exposure device 4, a process cartridge 5, and a fuser 100, which are accommodated a main body 2. The sheet feeder 3 may feed sheets P to the process cartridge 5, the process cartridge 5 may transfer toner images on the sheets P, and the fuser 100 may thermally fix the toner images on the sheets P.

The sheet feeder 3 is disposed at a lower position in the main body 2 and includes a feeder tray 31, a sheet-lifting plate 32, a feeder roller 33, a feeder pad 34, dust-remover rollers 35, 36, and a registration roller 37. The feeder tray 31 may store the sheets S therein, and the sheet-lifting plate 32 may uplift a frontward side of the sheets S in the feeder tray 31. The sheets S uplifted by the sheet-lifting plate 32 may be placed closer to the feeder roller 33 and separated individually by the feeder roller 33 and the feeder pad 34 to be conveyed through the dust-remover rollers 35, 36 and the registration roller 37 toward the process cartridge 5.

The exposure device 4 is disposed at an upper position in the main body 2 and includes a laser emitter (not shown), a polygon mirror 41, lenses 42, 43, and reflector mirrors 44, 45, 46. A laser beam may be emitted, as illustrated in double-dotted line in FIG. 1, at a surface of a photosensitive drum 61 in the process cartridge 5 via the polygon mirror 41, the lens 42, the reflector mirrors 44, 45, the lens 43, and the reflector mirror 46 so that the surface of the photosensitive drum 61 may be selectively exposed to the laser beam.

The process cartridge 5 is disposed at a lower position with respect to the exposure device 4. The process cartridge 5 may be detachably attached to the main body 2 through an opening, which may be exposed when a front cover 21 of the main body 2 is open. The process cartridge 5 includes a drum unit 6 and a developer unit 7.

The drum unit 6 includes the photosensitive drum 61, a charger 62, and a transfer roller 63. The developer unit 7 may be detachably attached to the drum unit 6 and includes a developer roller 71, a supplier roller 72, and a spreader blade 73, a toner container 74 to contain toner.

As the photosensitive drum 61 rotates in the process cartridge 5, the surface of the photosensitive drum 61 may be electrically evenly charged by the charger 62 and partly exposed to the laser beam emitted from the exposure device 4 so that the areas exposed to the laser beam may form an electrostatic latent image according to image data, and the electrostatic latent image may be carried on the surface of the photosensitive drum 61. Meanwhile, the toner in the toner container 74 may be supplied to the developer roller 71 through the supplier roller 72. As the developer roller 71 rotates, the spreader blade 73 may flatten the toner evenly on a surface of the developer roller 71 so that the developer agent may be carried on the surface of the developer roller 71 in a layer.

Thereafter, the toner carried on the developer roller 71 may be supplied to the electrostatic latent image on the photosensitive drum 61 to visualize the electrostatic latent image and develop an image in the toner on the photosensitive drum 61. The sheet S fed by the sheet feeder 3 may be carried to a position between the photosensitive drum 61 and the transfer roller 63 so that the image in the developer agent on the photosensitive drum 61 may be transferred onto the sheet S.

The fuser 100 is disposed at a rearward position with respect to the process cartridge 5. The sheet P with the transferred toner image may be conveyed through the fuser 100 so that the toner image may be thermally fixed onto the sheet P. The sheet P with the thermally fixed toner image may be ejected out of the main body 2 by conveyer rollers 23, 24 and placed on an ejection tray 22.

Figure 2:
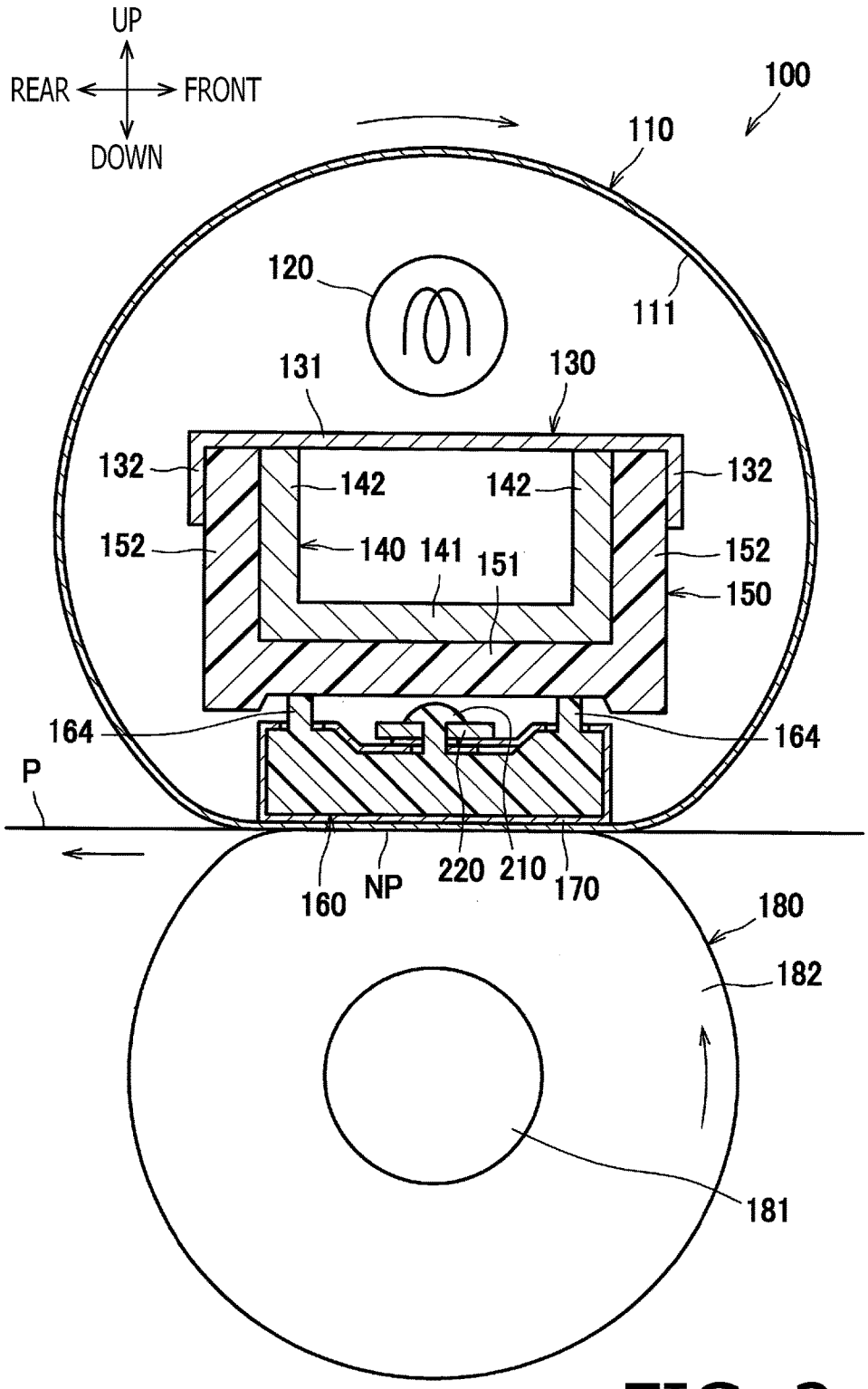
FIG. 2 is a cross-sectional view of the fuser according to the embodiment of the present disclosure.

The fuser 100 includes, as shown in FIG. 2, an endless belt 110, a halogen lamp 120, a reflector 130, a stay 140, a heat insulator 150, a base member 160, a sheet member 170, and a pressurizer roller 180. Optionally, the pressurizer roller 180 may be a driving roller to drive an endless belt, which is a belt different from the endless belt 110.

According to the present embodiment, the sheet P being conveyed to a nipping position NP, which will be described later, may move along the front-rear direction. In other words, a moving direction for the sheet P to move at the nipping position NP may be in parallel with the front-rear direction. An upstream side with regard to the moving direction may correspond to the frontward side of the laser printer 1, and a downstream side with regard to the moving direction may correspond to the rearward side of the laser printer 1. Meanwhile, an axial direction of the pressurizer roller 180 may be in parallel with the widthwise direction. One side along the axial direction may correspond to the rightward side in the laser printer 1, and the other side along the axial direction may correspond to the leftward side in the laser printer 1. Moreover, the base member 160 and the pressurizer roller 180 may nip the endless belt 110 in there-between along an orthogonal direction, which may be orthogonal to the axial direction and to the moving direction and may be in parallel with the vertical direction. One side, e.g., a side on which the base member 160 is arranged, along the orthogonal direction may be an upper side in the laser printer 1; and the other side, e.g., a side on which the pressurizer roller 180 is arranged, along the orthogonal direction may be a lower side in the laser printer 1. In other words, the front-rear direction, the widthwise direction, and the vertical direction mentioned above may as well be referred to as the moving direction, the axial direction, and the orthogonal direction, respectively.

The endless belt 110 may be a heat-resistant flexible belt including a base tube made of metal, such as stainless steel, and a coating layer of fluorine resin formed on a peripheral surface of the base tube. The endless belt 110 is rollably supported at widthwise ends thereof by lateral guides, which are not shown. The halogen lamp 120, the reflector 130, the stay 140, the heat-insulator 150, the base member 160, and the sheet member 170 are arranged on an inner side of the endless belt 110. In other words, the endless belt 110 is looped around the halogen lamp 120, the reflector 130, the stay 140, the heat-insulator 150, the base member 160, and the sheet member 170. A width of the endless belt 110 along the widthwise direction may be smaller than widths of the internal members, e.g., the halogen lamp 120, the reflector 130, the stay 140, the heat-insulator 150, the base member 160, and the sheet member 170, arranged inside the endless belt 110.

Optionally, the endless belt 110 may have a rubber layer on the peripheral surface of the metal base tube, and further, may have a protector coating layer made of a non-metallic material such as fluorine over the rubber layer. Meanwhile, the endless belt 110 may be a resin belt mainly made of polyimide, and an outer surface of the resin-made endless belt 110 may be coated with fluorine resin such as polytetrafluoroethylene.

The halogen lamp 120 is a heat source to heat the endless belt 110 and is arranged to be spaced apart for a predetermined distance from an inner peripheral surface 111 of the endless belt 110. The halogen lamp 120 is elongated in the widthwise direction.

The reflector 130 may reflect heat radiated from the halogen lamp 120 at the inner peripheral surface 111 of the endless belt 110 and is arranged to be spaced apart for a predetermined distance from the halogen lamp 120. In particular, the reflector 130 is disposed at a lower position with respect to the halogen lamp 120 so that the heat radiated from the halogen lamp 120 may be reflected upward to heat an upper part of the endless belt 110.

Figure 3:
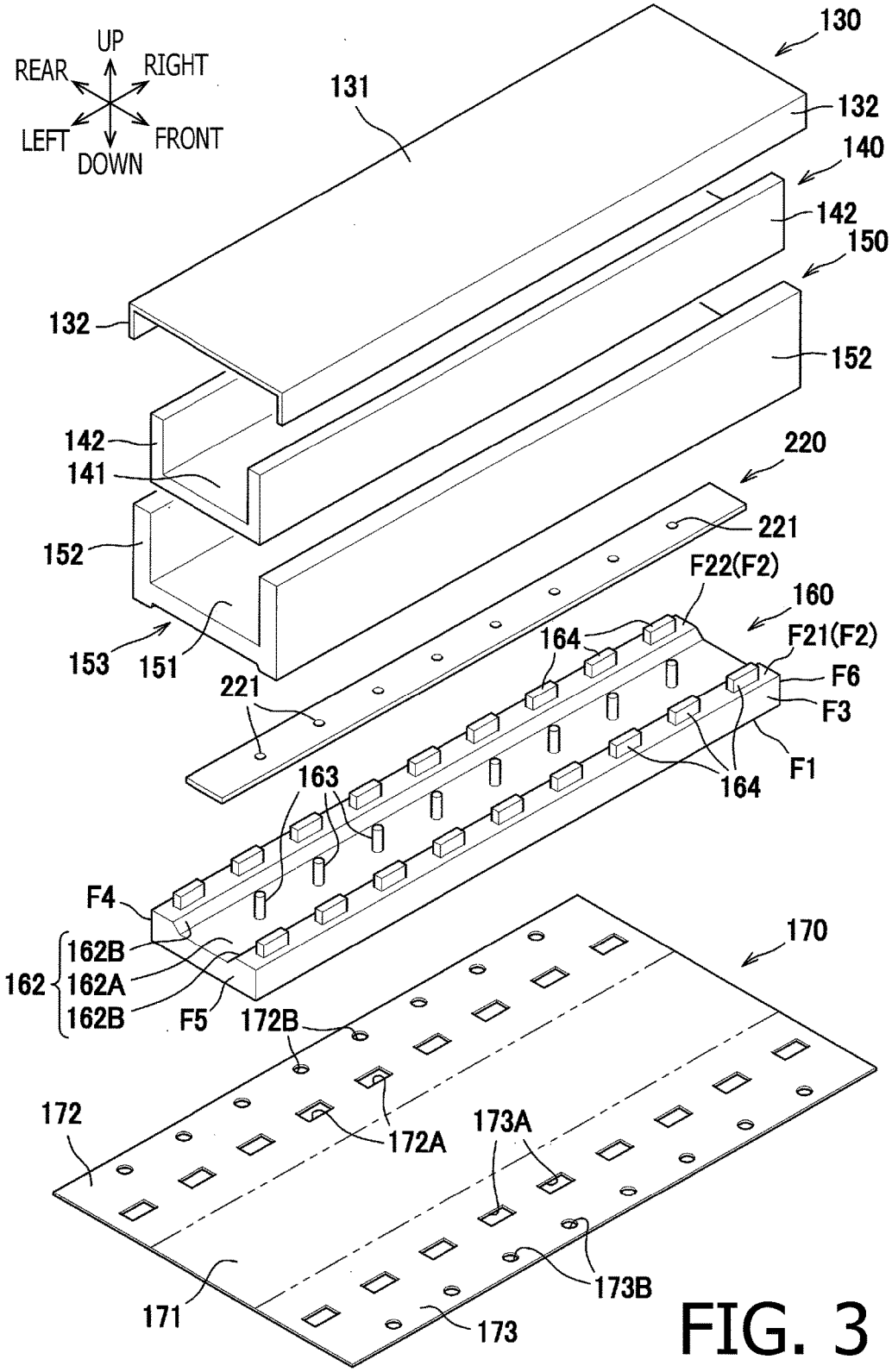
FIG. 3 is an exploded view of a reflector, a stay, a heat insulator, a metal plate, a base member, and a sheet member in the fuser according to the embodiment of the present disclosure.

The reflector 130 includes, as shown in FIGS. 2 and 3, a base portion 131 elongated in the widthwise direction and two (2) flange portions 132, which extend downward from a frontward end and a rearward end of the base portion 131. The reflector 130 may be made of metal such as aluminum, and at least an upper surface of the base portion 131 may be specular.

The stay 140 is disposed at a lower position with respect to the base portion 131 of the reflector 130. The stay 140 includes a base portion 141 elongated in the widthwise direction and two (2) flange portions 142, which extend upward from a frontward end and a rearward end of the base portion 141. An upper end of each flange portion 142 contacts a lower surface of the base portion 131 of the reflector 130. The stay 140 may be made of metal, of which rigidity is higher than rigidity of the reflector 130, such as steel.

The heat insulator 150 may be made of heat resistant resin such as liquid crystalline polymer. The heat insulator 150 is located at a lower position with respect to the base portion 131 of the reflector 130 to cover the stay 140 from below. The heat insulator 150 includes a base portion 151 elongated in the widthwise direction and two (2) side walls 152, which extend upward from a frontward end and a rearward end of the base portion 151.

A lower face of the base portion 151 is formed to have an upward recessed portion 153, which recesses upward. The upward recessed portion 153 is formed at a central area with regard to the front-rear direction on a lower face of the base portion 151 and throughout a width of the base portion 151 along the widthwise direction.

The heat insulator 150 and the stay 140 are arranged such that the base portion 151 contacts a lower face of the base portion 141. Meanwhile, upper ends of the side walls 152 of the heat insulator 150 contact a lower face of the base portion 131 of the reflector 130. The upper end of each side wall 152 is placed between the flange portion 142 of the stay 140 and the flange portion 132 of the reflector 130 along the front-rear direction. The heat insulator 150 may be made of a material with lower thermal conductivity, e.g., resin, than the stay 140.

The base member 160 and the pressurizer roller 180 form the nipping position NP at a position in there-between, at which the endless belt 110 is nipped by the base member 160 and the pressurizer roller 180. An outer peripheral surface of the base member 160 is wrapped around by the sheet member 170.

The pressurizer roller 180 may be driven to be rotated by a driving force transmitted from a motor, which is not shown, disposed in the main body 2. As the pressurizer roller 180 rotates, a friction force produced between the endless belt 110 and the pressurizer roller 180 causes the endless belt 110 to roll. The sheet P with the toner image transferred thereon may be conveyed through the position between the pressurizer roller 180 and the heated endless belt 110 so that the toner image may be fused and thermally fixed on the sheet P.

The pressurizer roller 180 may convey the sheet P in conjunction with the base member 160 through the endless belt 110. The pressurizer roller 180 is located at a lower position with respect to the base member 160 to nip the endless belt 110 at the position between the pressurizer roller 180 and the base member 160. The pressurizer roller 180 includes a shaft 181 made of metal and a resilient roller body 182 arranged on an outer circumference of the shaft 181. The pressurizer roller 180 and the base member 160 are in an arrangement such that one of the pressurizer roller 180 and the base member 160 is pressed against the other.

The base member 160 is formed in a shape of a rectangular bar elongated in the widthwise direction. The base member 160 may be made of heat-resistant resin such as liquid crystalline polymer. A lengthwise direction of the base member 160 may coincide with the widthwise direction and may therefore be equated with the axial direction and the widthwise direction. The base member 160 is arranged between the base portion 151 of the heat insulator 150 and the endless belt 110.

The base member 160 includes a first face F1, which is arranged to contact a contact portion 171 of the sheet member 170; and a second face F2, a third face F3, a fourth face F4, a fifth face F5, and a sixth face F6, which are different faces from the first face F1. The first face F1 and the second face F2 spread orthogonally to the vertical direction, and the second face F2 is at an upper position with respect to the first face F1. Specifically, the second face F2 may be on a side opposite to the first face F1. At a central area with regard to the front-rear direction in the second face F2, formed is a recess 162, elongated along the widthwise direction and recessed downward from the second face F2.

The third face F3 spreads orthogonally to the front-rear direction and connects a frontward end of the first face F1 with a frontward end of the second face F2. The fourth face F4 spreads orthogonally to the front-rear direction and connects a rearward end of the first face F1 with a rearward end of the second face F2.

The fifth face F5 spreads orthogonally to the widthwise direction and connects leftward ends of the first face F1, the second face F2, the recess 162, the third face F3, and the fourth face F4 with one another. The sixth face F6 spreads orthogonally to the widthwise direction and connects rightward ends of the first face F1, the second face F2, the recess 162, the third face F3, and the fourth face F4 with one another.

The recess 162 includes a bottom face 162A elongated along the widthwise direction and two (2) side faces 162B that extend from a frontward end and a rearward end of the bottom face 162A toward the second face F2. The bottom face 162A and the side faces 162B form inner faces of the recess 162. The bottom face 162A spreads orthogonally to the vertical direction from one end to the other end of the base member 160 throughout a width of the base member 160 along the widthwise direction.

On the bottom face 162A, arranged are a plurality of protrusions 163. The protrusions 163 are each in a cylindrical form and are formed integrally with the base member 160 to protrude upward from the bottom face 162A. The protrusions 163 align spaced apart from one another on the bottom face 162A along the widthwise direction. A tip end of each protrusion 163 may form an expanded portion 210 (see FIG. 5), which is plastically deformed by thermal swaging with a thermal-swaging pin 300 (see FIG. 4) to expand outward in a radial direction of the cylindrical shape. Meanwhile, a lower and cylindrical part of each protrusion 163 lower than the expanded portion 210 closer to the bottom face 162A is a common engagement portion 163A (see FIG. 5), which is engageable with an edge of a first hole 172B and an edge of a second hole 173B formed in the sheet member 170. In other words, a part of each protrusion 163 in a predetermined range from the tip end may form the expanded portion 210, and another part of the protrusion 163 in a predetermined basal range may form the common engagement portion 163A. Meanwhile, the edges of the holes 172B, 173B, which will be described later in detail, refer to inner peripheral edges that outlines the holes 172B, 173B respectively, in the sheet member 170.

The expanded portion 210 is formed integrally with the common engagement portion 163A to expand from the common engagement portion 163A along the bottom face 162A. The expanded portion 210 is located at a lower position than tip ends of protrusive blocks 164, which will be described below.

The side faces 162B incline with respect to the bottom face 162A and the second face F2 and extend from one end to the other end of the base member 160 throughout the width of the base member 160 along the widthwise direction. Specifically, a frontward one of the side faces 162B extends obliquely upper-frontward from a frontward end of the bottom face 162A, and a rearward one of the side faces 162B extends obliquely upper-rearward from a rearward end of the bottom face 162A. Therefore, an angle $\alpha$ (see FIG. 4) between the side face 162B and the second face F2 is obtuse. In the meantime, a corner between the side face 162B and the second face F2 may not necessarily be edgy but may be rounded to some extent.

On a frontward portion F21 of the second face F2 located frontward with respect to the recess 162, formed are a plurality of protrusive blocks 164, which protrude in rectangular shapes from the second face F2. The protrusive blocks 164 are elongated in the widthwise direction and spaced apart from one another along the widthwise direction.

Meanwhile, on a rearward portion F21 of the second face F2 located rearward with respect to the recess 162, formed are a plurality of protrusive blocks 164, which protrude in rectangular shapes from the second face F2. The protrusive blocks 164 are elongated in the widthwise direction and spaced apart from one another along the widthwise direction. The protrusive blocks 164 are arranged on the frontward portion F21 and the rearward portion F22 of the second face F2 such that upper ends thereof may contact the base portion 151 of the heat insulator 150.

The sheet member 170 is a piece of fabric saturated with lubricant and is placed to wrap around the base member 160. A thickness of the sheet member 170 may range, for example, between 0.05 and 0.55 mm. Meanwhile, the sheet member 170 may not necessarily be a piece of fabric but may be a sheet of extruded resin such as polyimide.

Materials for the sheet member 170, selection to use or not to use the lubricant, or types of the lubricant may not necessarily be limited to those mentioned above but may be selected from multiple options as long as intensity of kinetic friction force of the sheet member 170 with the endless belt 110 is reduced to be lower than kinetic friction force of the base member 160 with the endless belt 110.

The sheet member 170 may be in a rectangular shape having the contact portion 171, a first portion 172, and a second portion 173. The contact portion 171 includes a contacting surface 171A and an opposite surface 171B that is on a side opposite to the contacting surface 171A. The contacting surface 171A may contact the inner peripheral surface 111 of the endless belt 110. The first portion 172 extends rearward from one end with regard to the front-rear direction of the contact portion 171, i.e., a rearward end. The second portion extends frontward from the other end with regard to the front-rear direction of the contact portion 171, i.e., a frontward end. It may be noted in FIG. 3 that boundaries of the contact portion 171 with the first portion 172 and the second portion 173 are indicated by dash-and-dots lines for a purpose of illustration.

The first portion 172 includes a plurality of first allowance holes 172A and a plurality of first holes 172B. The first allowance holes 172A are arranged to correspond to the plurality of protrusive blocks 164 on the rearward portion F22 of the second face F2, and the first holes 172B are arranged to correspond to the plurality of the common engagement portions 163A. Each of the first allowance holes 172A is a rectangular hole, in which the protrusive block 164 may loosely fit. The first allowance holes 172A are formed at positions between the first holes 172B and the contact portion 171. Meanwhile, each of the first holes 172B is a round hole, in which the common engagement portion 163A may fit. The first holes 172B are formed at positions closer than the first allowance holes 172A to an edge of the first portion 172, i.e., an edge opposite to the contact portion 171.

The second portion 173 includes a plurality of second allowance holes 173A and a plurality of second holes 173B. The second allowance holes 173A are arranged to correspond to the plurality of protrusive blocks 164 on the frontward portion F21 of the second face F2, and the second holes 173B are arranged to correspond to the plurality of the common engagement portions 163A. Each of the second allowance holes 173A is a rectangular hole, in which the protrusive block 164 may loosely fit. The second allowance holes 173A are formed at positions between the second holes 173B and the contact portion 171. Each of the second holes 173B is a round hole, in which the common engagement portion 163A may fit. The second holes 173B are formed at positions closer than the second allowance holes 173A to an edge of the second portion 173, i.e., an edge opposite to the contact portion 171.

Figure 5:
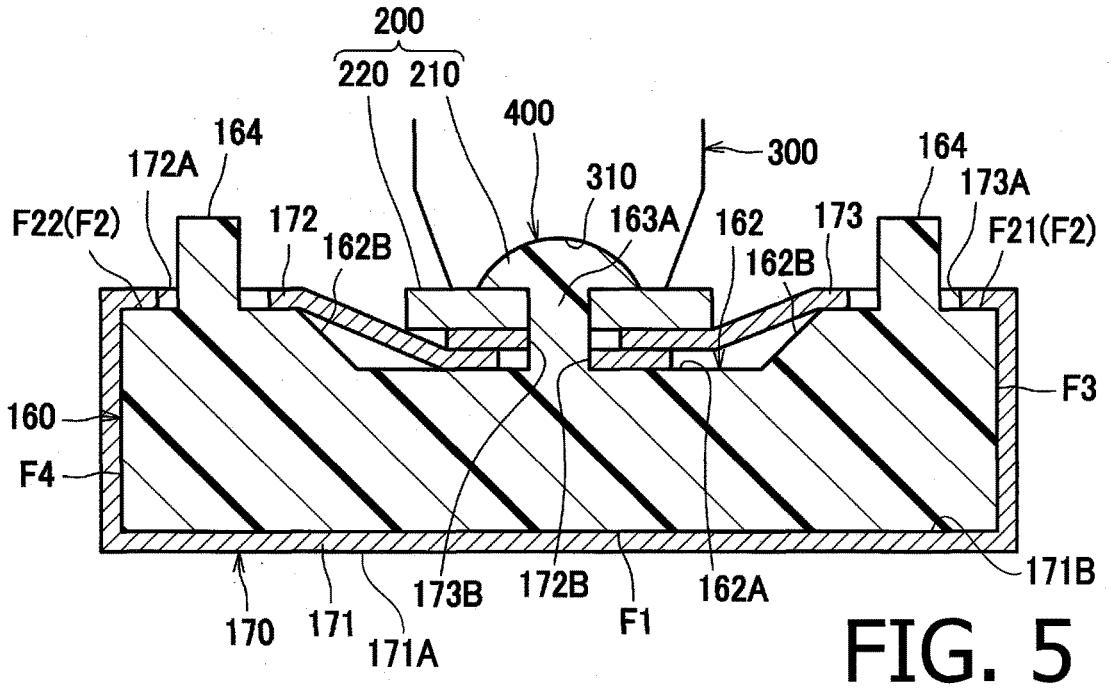
FIG. 5 is a cross-sectional view of the sheet member wrapped around the base member with end portions of the sheet member set inside the recess in the base member according to the embodiment of the present disclosure.

As shown in FIG. 5, ends of the sheet member 170 with regard to the front-rear direction, i.e., the edges of the first portion 172 and the second portion 173, are set in the recess 162 in the base member 160 and fixed to the base member 160 by a fixing portion 400. In other words, while the sheet member 170 is in a fixed state to be fixed to the base member 160, portions of the sheet member 170 that are periphery to the first holes 172B and to the second holes 173B are set in the recess 162.

In particular, when the sheet member 170 is in the fixed state to the base member 160, the contact portion 171 of the sheet member 170 contacts the first face F1, and the first portion 172 contacts the fourth face F4, the rearward portion F22 of the second face F2, and the bottom face 162A of the recess 162. Meanwhile, the second portion 173 contacts the third face F3, the frontward portion F21 of the second face F2, and the first portion 172.

The fixing portion 400 includes the common engagement portions 163A and a holder 200, which may hold the peripheral portions around the first and second holes 172B, 173B in the sheet member 170 set in the recess 162. The holder 200 may hold the peripheral portions around the first and second holes 172B, 173B at intervening positions between the bottom face 162A of the recess 162 and the holder 200. The holder 200 includes the expanded portions 210 and a metal plate 220. As shown in FIG. 3, the metal plate 220 may be a bar elongated in the widthwise direction and includes a plurality of holes 221, in which the protrusions 163 may be inserted. The metal plate 220 may be attached to the protrusions 163 through the holes 221.

As shown in FIG. 5, the metal plate 220 has a dimension along the bottom face 162A, e.g., along the front-rear direction, being larger than a dimension of a molding surface 310 of a thermal-swaging pin 300. The molding surface 310 is curved to form the expanded portion 210 there-along. A frontward edge of the metal plate 220 is located frontward with respect to the molding face 310, and a rearward edge of the metal plate 220 is located rearward with respect to the molding face 310.

The metal plate 220 is, together with the frontward and rearward end portions of the sheet member 170, i.e., the peripheral portions around the holes 172B, 173B, which are tucked to overlap each other in the recess 162, pinched to be wedged at an intermediate position between the expanded portion 210 and the bottom 162. Therefore, in the wedged state, the metal plate 220 is in contact with the expanded portion 210 and the sheet member 170. With the metal plate 220 and the end portions of the sheet member 170 wedged between the expanded portion 210 and the bottom face 162A, the end portions of the sheet member 170 are fixed to the base member 160.

With the sheet member 170 being fixed to the base member 160, the edges of the first holes 172B and the edges of the second holes 173B, i.e., round figures that outline the holes 172B, 173B in the sheet member 170, are engaged with the common engagement portions 163A, and the sheet member 170 may be wrapped tensely around the base member 160.

Figure 4:
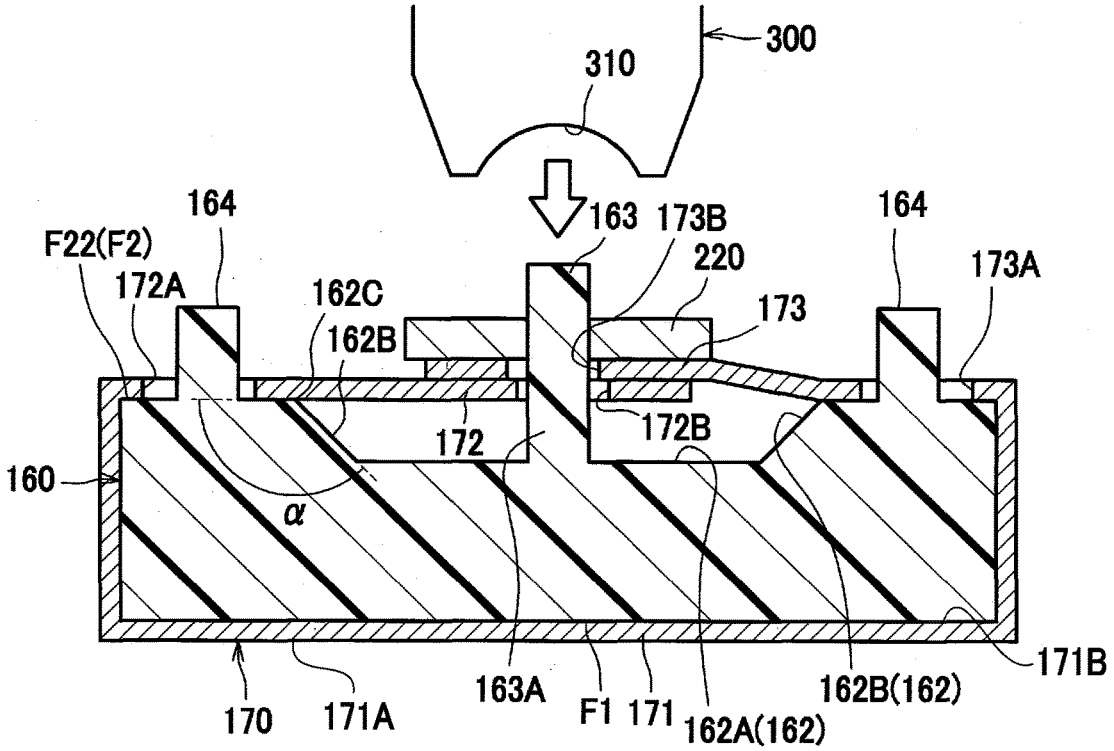
FIG. 4 is a cross-sectional view of the sheet member wrapped around the base member with end portions of the sheet member staying outside a recess in the base member according to the embodiment of the present disclosure.

In particular, as shown in FIG. 4, in an intermediate state where the protrusions 163 are merely hooked to the holes 172B, 173B, the frontward and rearward end portions of the sheet member 170, i.e., the peripheral portions around the holes 172B, 173B are located outside above the recess 162, and as long as the peripheral portions of the sheet member 170 around the holes 172B, 173B are located outside the recess 162, the edges of the holes 172B, 173B may not be engaged with the common engagement portions 163A. From this intermediate state, the frontward and rearward end portions of the sheet member 170 may be pushed into the recess 162; thereby, as shown in FIG. 5, the edges of the holes 172B, 173B become engaged with the common engagement portions 163A while the sheet member 170 is tightened around the base member 160.

More specifically, as the frontward and rearward end portions of the sheet member 170 are pushed into the recess 162, the sheet member 170 may bent at edges 162C of the recess 162, and the first holes 172B and the second holes 173B may move leftward and rightward respectively in FIG. 5 so that the sheet member 170 may be tightened around the base member 160.

In this regard, a timing when the edges of the holes 172B, 173B should be engaged with the common engagement portions 163A may be determined desirably depending on a tensile force to be produced in the sheet member 170 as long as the edges of the holes 172B, 173B are engaged with the common engagement portions 163A eventually in the fixed state where the sheet member 170 is fixed to the base member 160. In other words, the earlier the edges of the holes 172B, 173B start being engaged with the common engagement portions 163A, the more intense the tensile force to be produced in the sheet member 170 becomes; therefore, the timing, or positions and/or sizes, for the edges of the holes 172B, 173B to be engaged with the common engagement portions 163A may be determined based on a desirable intensity of the tensile force.

For example, the holes 17 of the holes 172B, 173B are engaged with the common engagement portions 163A beforehand 2B, 173B may be formed at positions, in which the edges while the frontward and rearward ends of the sheet member 170 are outside the recess 162 as long as the sheet member 170 is tightened around the base member 160. For another example, the holes 172B, 173B may be formed at positions, in which the edges of the holes 172B, 173B are gradually engaged with the common engagement portions 163A as the frontward and rearward ends of the sheet member 170 are being pushed into the recess 162.

Meanwhile, in the fixed state where the sheet member 170 is fixed to the base member 160, clearances may be allowed between edges of the first allowance holes 172A closer to the contact portion 171 and the protrusive blocks 164 and between edges of the second allowance holes 173A closer to the contact portion 171 and the protrusive blocks 164. In any way, the edges of the first and second allowance holes 172A, 173A may contact or collide against the protrusive blocks 164 as long as the collision do not prevent the sheet member 170 from being tensed.

Next, below will be described a method to manufacture the fuser 100.

As shown in FIG. 4, when the sheet member 170 is to be wrapped around the base member 160, the first allowance holes 172A and the second allowance holes 173A in the sheet member 170 are placed over the protrusive blocks 164, and the first holes 172B and the second holes 173B are placed to overlap the common engagement portions 163A (Step 1). In other words, the inner edges of the first holes 172B and the second holes 173B are placed on the common engagement portions 163A. In this regard, FIG. 4 may illustrate the frontward and rearward end portions of the sheet member 170, i.e., the peripheral portions around the first holes 172B and the second holes 173B, being located outside the recess 162 for the illustrative purpose. However, the end portions may practically droop down in the recess 162 to some extend due to the effect of gravity, and the edges of the first and second holes 172B, 173B may be engaged with the common engagement portions 163A at the drooped positions.

After Step 1, the protrusions 163 are inserted in the holes 221 in the metal plate 220, and the metal plate 220 is placed on the overlapped end portions of the sheet member 170 so that the metal plate 220 is attached to the common engagement portions 163A. Thereafter, the thermal-swaging pins 300 are pressed against tip ends of the protrusions 163 so that the tip ends may be plastically deformed. The tip ends of the protrusions 163 are therefore plastically deformed into the expanded portions 210, as shown in FIG. 5, so that the expanded portions 210 and the thermal-swaging pins 300 may push the metal plate 220 and the end portions of the sheet member 170 into the recess 162 against the bottom face 162A (Step 2).

As the end portions of the sheet member 170 are pushed into the recess 162, the sheet member 170 may be gradually tensed, and in the state where the metal plate 220 and the end portions of the sheet member 170 are wedged between the expanded portions 210 and the bottom face 162A, the sheet member 170 is held tensely by the holder 200. Thus, the sheet member 170 may be prevented from being loosened to be displaced from a correct position.

Once the sheet member 170 is fixed to the base member 160, the items and members illustrated in FIG. 2 may be assembled together to complete the fuser 100.

Below will be described benefits achievable by the embodiment of the present disclosure described above.

The tip ends of the protrusions 163 are plastically deformed into the expanded portions 210, which serve as the holder 200, formed integrally with the common engagement portions 163A. Therefore, for example, compared with a holder being a washer, in which male screws formed at the tip ends of the protrusions are screwed, in other words, compared to a holder with expanded portions which are formed as separate parts from the common engagement portions, a quantity of items in the fuser 100 may be reduced.

The sheet member 170, in particular, the peripheral portions around the first and second holes 172B, 173B of the sheet member 170 are wedged at the position between the holder 200 and the bottom face 162A of the recess 162. Therefore, dislocation of the sheet member 170 may be prevented.

The base member 160 has the side faces 162B of the recess 162 that incline with respect to the second face F2. Therefore, compared to, for example, a base member with side faces that are orthogonal to the second face F2, the angle of each corner between the side face 162B and the second face F2 is enlarged to be obtuse so that stress to be caused in the sheet member 170 by the edges 162C of the recess 162 may be moderated.

Both of the end portions of the sheet member 170 may be pushed into the recess 162 to be held at a single position with regard to the front-rear direction by the holder 200 collectively. Therefore, compared to, for example, a configuration, in which one and the other of the end portions of the sheet member 170 are held at different positions separately, the sheet member 170 may be fixed to the base member 160 in the easier and less complicated manufacturing procedure.

Figure 8A:
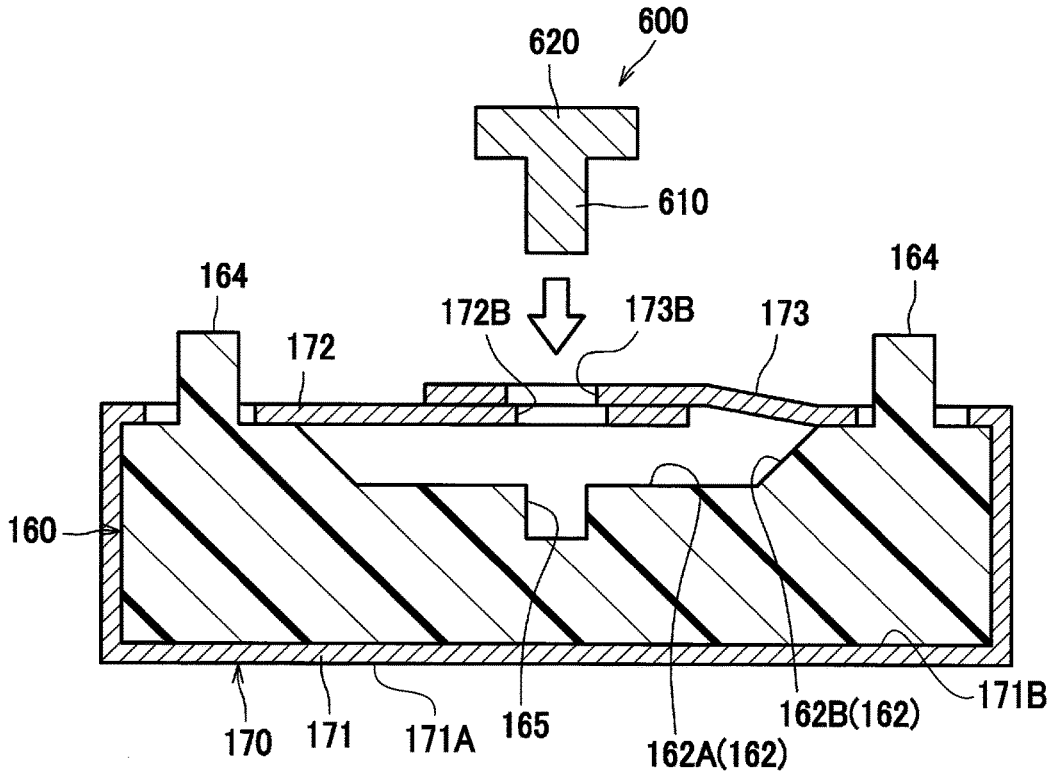
FIGS. 8A-8B are cross-sectional views of a base member with a sheet member wrapped around in another modified example of the embodiment according to the present disclosure.
Figure 8B:
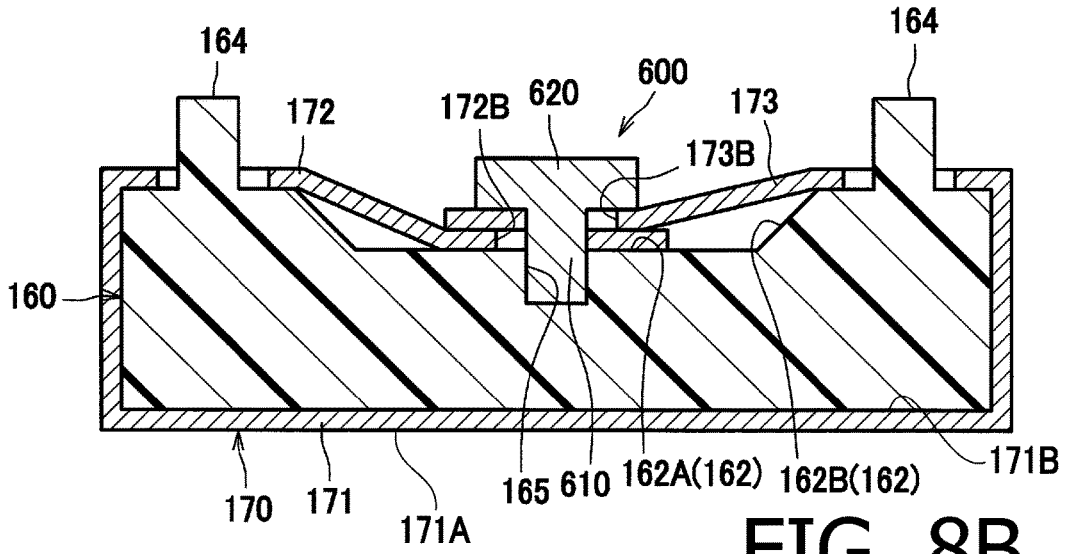

The common engagement portions 163A are formed integrally with the base member 160 to protrude from the bottom face 162A of the recess 162. Therefore, compared to, for example, common engagement portions that are formed separately from the base member as shown in FIGS. 8A-8B, the holes 172B, 173B in the sheet member 170 may be engaged with the common engagement portions 163A in the easier and less complicated manufacturing procedure.

The plurality of first holes 172B and the plurality of second holes 173B are formed at positions corresponding to the plurality of common engagement portions 163A, which are arranged along the widthwise direction. Therefore, the sheet member 170 may be fixed to the base member 160 preferably at each widthwise position corresponding to the common engagement portions 163A.

The sheet member 170 may be fixed to the base member 160 throughout the length along the widthwise direction by the metal plate 220, which is elongated in the widthwise direction, in the single action. Therefore, the sheet member 170 may be tightened efficiently throughout the longitudinal range along the widthwise direction.

The tip ends of the protrusions 163 are plastically deformed by thermal-swaging to form the expanded portions 210. Therefore, compared to, for example, a mechanically-swaging method to plastically deform tip ends of the protrusions, the expanded portions 210 may be formed in the easier action.

The metal plate 220 has the widthwise dimension, which is larger than the widthwise dimension of the molding surface 310 of the thermal-swaging pin 300. Therefore, the thermal-swaging pins 300 may be restrained from contacting the sheet member 170 effectively by the metal plate 220.

Although an example of carrying out the invention has been described, those skilled in the art will appreciate that there are numerous variations and permutations of the fuser and the manufacturing method for the fuser that fall within the spirit and scope of the disclosure as set forth in the appended claims.

Below will be described varied examples derivable from the embodiment described above. In the following examples, items or structures which are substantially the same as or similar to those described in the above embodiment may be denoted by the same reference signs, and description of those may be omitted.

For example, the holder 200 may not necessarily include the expanded portions 210 and the metal plate 220, but solely the expanded portions 210 may serve as the holder 200.

Figure 6A:
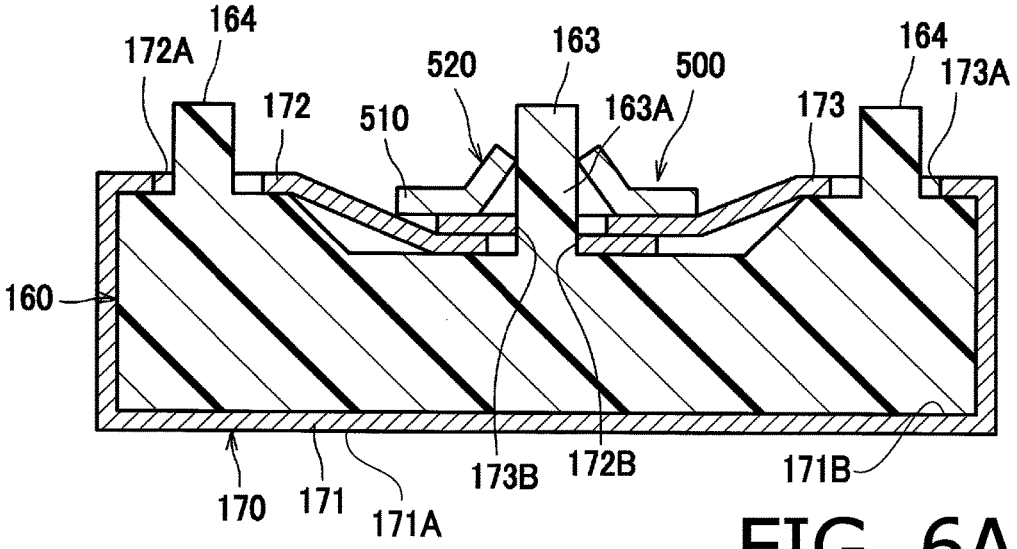
FIGS. 6A and 6B are a cross-sectional view and a perspective view of a base member with a sheet member wrapped around in a modified example of the embodiment according to the present disclosure.
Figure 6B:
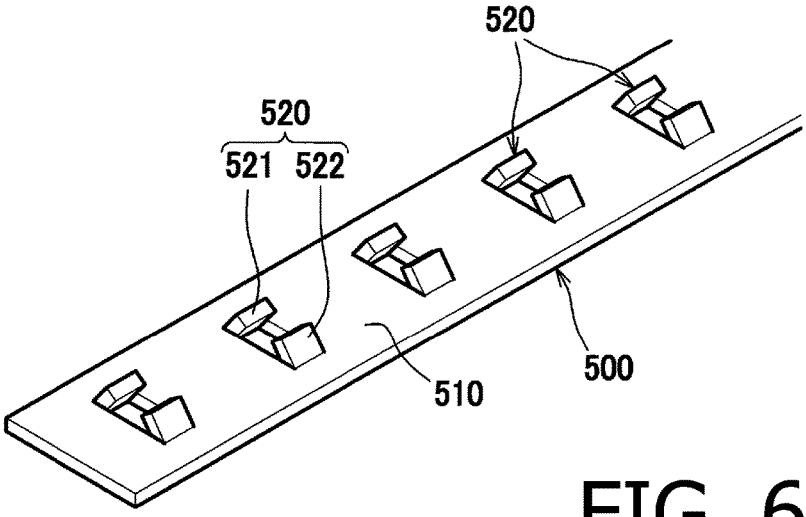

For another example, as shown in FIGS. 6A-6B, a piece of holder member 500, which may be a metal plate, alone may serve as the holder. In particular, the holder member 500 may include a metal piece 510, which is elongated in the widthwise direction and spreads orthogonally to the vertical direction, and a plurality of springs 520. Each spring 520 may include paired spring tips 521, 522, which may be formed by press-cutting and bending the metal piece 510 at a plurality of positions. The springs 520 may be spaced apart along the widthwise direction from one another to coincide with the positions of the protrusions 163.

In this exemplary configuration, shapes of the tip ends of the protrusions 163 may be maintained unchanged without being thermally swaged before and after the sheet member 170 is fixed to the base member 160. Meanwhile, the tip ends of the protrusions 163 may be located at positions at a same height as or lower than the tip ends of the protrusive blocks 164. When the tip ends of the protrusions 163 are at the same height as the tip ends of the protrusive blocks 164, the tip ends of the protrusions 163 may be placed to contact against a lower surface of the heat insulator 150 so that protrusions 163 and the protrusive blocks 164 may be supported by the heat insulator 150.

In order to assemble the holder member 500 with the base member 160, the springs 520 may be placed over the protrusions 163 and deformed against the protrusions 163. The plate member 510 may be pushed toward the bottom face 162A of the recess 162 so that the end portions of the sheet member 170 may be wedged between the plate member 510 and the bottom face 162A. In this regard, at the position where the plate member 510 may wedge the end portions of the sheet member 170 together with the bottom face 162A, the holder member 500 may be fixed to the protrusions 163 by resilient force of the springs 520. With the modified configuration, the benefits achievable by the embodiment described above may be analogously achieved.

Figure 7:
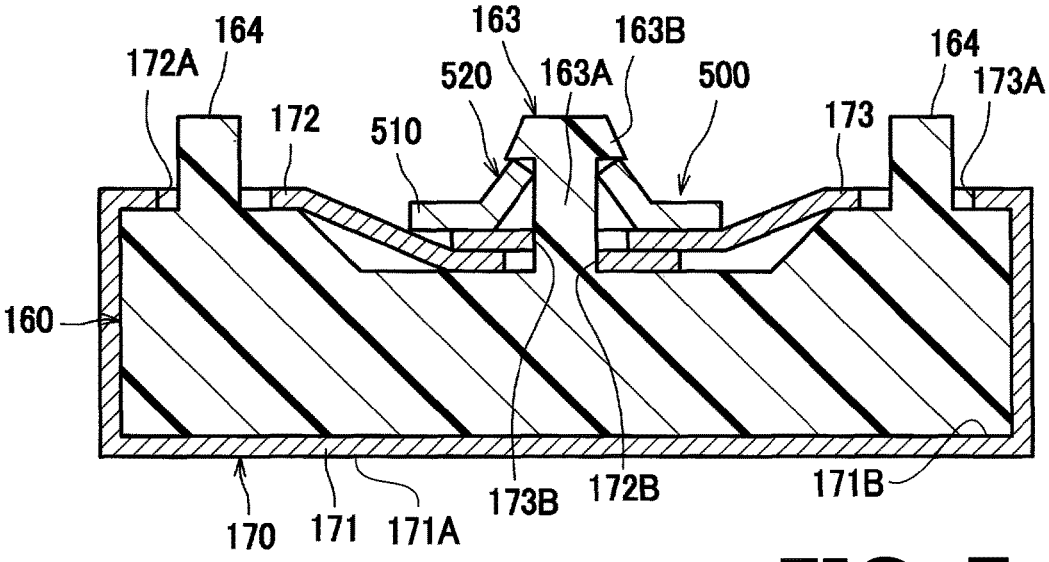
FIG. 7 is a cross-sectional view of a base member with a sheet member wrapped around in another modified example of the embodiment according to the present disclosure.

Further, as shown in FIG. 7, flanges 163B to be engaged with the springs 520 may be located at the tip ends of the protrusions 163 in the modified embodiment as shown in FIG. 6. The flanges 163B may be formed to expand outward in the radial direction from the tip ends of the protrusions 163. The flanges 163B may be formed by mechanical or thermal swaging before the sheet member 170 is fixed to the base member 160. A circumference of each flange 163B may be tapered to be smaller upward.

In this exemplary configuration, in order to assemble the holder member 500 with the base member 160, the springs 520 may be placed to be engaged with the tapered surfaces of the flanges 163B, and, as the plate 510 is pushed toward the bottom face 162A of the recess 162, the springs 520 may be pushed outward by the tapered surfaces of the flanges 163B against the resilient force. Thereafter, once the springs 520 are pushed through the flanges 163B, the springs 520 may recover to the original shapes by the resilient force so that the springs 520 may be tightened around the common engagement portions 163A underneath the flanges 163B. Thus, the holder member 500 may be restrained from moving upward by the flanges 163B so that the end portions of the sheet member 170 may be held by the holder member 500 steadily.

For another example, the common engagement portions 163A may not necessarily be formed integrally with the base member 160. As shown in FIGS. 8A-8B, rods 610 of rivets 600 to serve as the common engagement portions may be provided separately from the base member 160. In particular, each rivet 600 may include a cylindrical rod 610 and a flange 620 which expands outward in a radial direction from an upper end portion of the rod 610. Meanwhile, engagement holes 165, in which the rods 610 may fit, may be formed at the bottom face 162A of the recess 162.

The engagement holes 165 may be formed at positions to coincide with the protrusions 163, and a quantity of the rivets 600 may be equal to the quantity of the engagement holes 165.

In this exemplary configuration, in order to fix the sheet member 170 to the base member 160 by the rivets 600, the rods 610 of the rivets 600 may be inserted through the holes 172B, 173B in the sheet member 170 and tightly fitted in the engagement holes 165 so that the edges of the holes 172B, 173B may be engaged with the rods 610. Thus, the flanges 620 in the rivets 600 may hold the end portions of the sheet member 170 to be pinched between the plate member 510 and the bottom face 162A, and the sheet member 170 may be fixed to the base member 160. Therefore, with the modified configuration, the benefits achievable by the embodiment described above may be analogously achieved. Further, even with the rivets 600 with the flanges 620, the metal plate 220 to hold the sheet member 170 pinched between the bottom face 162A of the base member 160 and the metal plate 220 may be arranged.

For another example, the edges of the first holes 172B and the second holes 173B may not necessarily be engaged with the same common engagement portions 163A but may be engaged with separate common engagement portions. That is, as shown in FIG. 9, first engageable portions 710 to be engaged with the edges of the first holes 172B and second engageable portions 720 to be engaged with the edges of the second holes 173B may be formed separately in the base member 160.

In particular, the first engagement portions 710 may be in substantially analogous configuration and arrangement to the common engagement portions 163A described above. That is, the first engagement portions 710 may be formed on the bottom face 162A of the recess 162, and tip ends of the first engagement portions 710 may have the expanded portions 210, which may be formed by thermal swaging. The second engagement portions 720 may be in a configuration and arrangement analogous to the protrusive blocks 164 described above. That is, the second engagement portions 720 may be rectangular protrusions which are arranged on the frontward portion F21 of the second face F2.

Meanwhile, the second holes 173B may be in rectangular shapes, which are engageable with the rectangular-shaped second engagement portions 720. The first holes 172B may remain in the round shapes. In this exemplary configuration, while the tip ends of the first engagement portions 710 may be thermally swaged, the first portion 172 of the sheet member 170 may be pushed into the recess 162 toward the bottom face 162A, and the edges of the holes 172B, 173B may be engaged with the first and second engagement portions 710, 720, respectively so that the sheet member 170 may be tensely wrapped around the base member 160. Thus, with the modified configuration, the benefits achievable by the embodiment described above may be analogously achieved.

Figure 9:
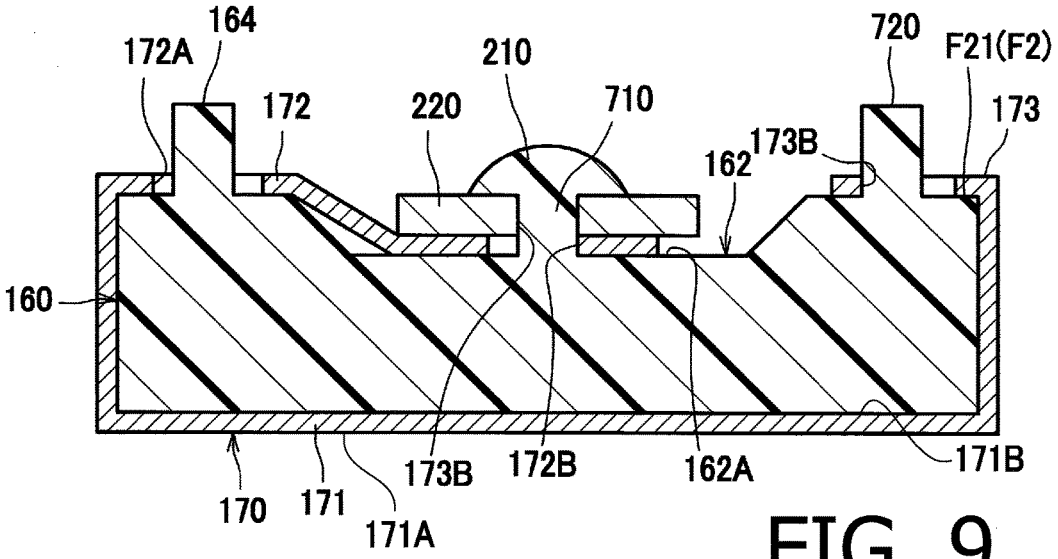
FIG. 9 is a cross-sectional view of a base member with a sheet member wrapped around in another modified example of the embodiment according to the present disclosure.

It may be noted that, in the exemplary configuration shown in FIG. 9, engagement of the edges of the second holes 173B may place the sheet member 170 fixed to the base member 160. However, manners to fix the second portion 173 to the base member 160 may not necessarily be limited to the manner illustrated in FIG. 9 or described above. For example, the second portion 173 may be fixed to the base member 160 by screws. In other words, the rivets 600 may be replaced with screws.

For another example, the metal plate 220 may be replaced with, for example, a resin plate, or columnar members made of metal or resin.

For another example, materials of the base member 160 may not necessarily be limited to resin but may include, for example, metal.

For another example, the second face F2, on which the recess 162 is formed, may not necessarily be provided on the side opposite to the first face F1 in the base member 160 as long as the second face F2 is on a different face from the first face F1. For example, the second face F2, on which the recess 162 is formed, may be arranged on a face that adjoins the first face F1.

For another example, the sheet member 170 may not necessarily be fixed immovably at the position between the holder 200 and the bottom face 162A as long as the sheet member 170 is arranged between the holder 200 and the bottom. For example, a clearance may be formed between the holder and the bottom so that the sheet member may be movable to some extent between the holder and the bottom face 162A.

For another example, not all the tip ends of the protrusions 163 may necessarily be thermally swaged. For example, solely one of the protrusions 163 that is at a widthwise center may be thermally swaged, or two of the tip ends of the protrusions that are on widthwise ends may be thermally swaged. Meanwhile, the base member 160 may be made of metal. Further, the protrusive blocks 164 of the base member 160 may be supported directly by the stay 140 without the intervention of the heat insulator 150.

For another example, the form of the expanded portions 210 may not necessarily be limited to the circular shape, in the plan view, of which diameter is larger than the diameter of the common engagement portion 163A. For example, the expanded portion 210 may include a protrusion that protrudes outward from a peripheral surface of the common engagement portion 163A.

For another example, the heat source in the fuser 100 may not necessarily be limited to the halogen lamp 120 but may include other heat sources such as a carbon heater and an induction heating coil.

For another example, the sheet P being a recording medium may not necessarily be limited to paper including cardboards, postcards, and tracing paper but may include, for example, an OHP sheet.

For another example, the pressurizer roller 180 to be pressed against the base member 160 may be replaced with, for example, a pressurizer belt. Meanwhile, the base member 160 may be placed on an inner side of a circulative heating belt, which may contact a heating roller with a heat source contained therein.

Further, the items and the parts in the configuration of the embodiment described above and the exemplary configuration may be combined arbitrarily or selectively.

It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

What is claimed is:

1. A fusing apparatus, comprising:

a base member;

a sheet member wrapped around the base member;

a fixing member fixing the sheet member to the base member; and an endless belt looped around the base member and the sheet member, the endless belt comprising an inner peripheral surface arranged to be in contact with the sheet member, wherein the sheet member comprises:

a contact portion comprising a contacting surface, on which the inner peripheral surface of the endless belt contacts the sheet member, and an opposite surface, which is on a side opposite to the contacting surface;

a first portion extending from a first end of the contact portion, the first portion comprising an inner edge that outlines a first hole; and a second portion extending from a second end of the contact portion, the second portion being fixed to the base member;

wherein the base member comprises:

a first face supporting the opposite surface of the contact portion of the sheet member;

a second face being a different face from the first face; and an inner face recessed from the second face to form a recessed portion, in which a peripheral portion around the first hole formed in the first portion of the sheet member is set; and wherein the fixing member comprises:

a first engagement portion protruding from the inner face of the recessed portion of the base member, the first engagement portion being engageable with the inner edge of the first hole; and a holder provided at the first engagement portion, the holder being configured to hold the peripheral portion around the first hole in the first portion of the sheet member between the inner face of the recessed portion of the base member and the holder.

2. The fusing apparatus according to claim 1, wherein the second face of the base member is on a side opposite to the first face; and wherein the holder of the fixing member is configured to pinch the peripheral portion around the first hole in the sheet member.

3. The fusing apparatus according to claim 1, wherein the inner face of the recessed portion of the base member comprises a bottom face and a side face connecting the bottom face with the second face;

wherein the side face inclines with respect to the second face; and wherein the first engagement portion protrudes from the bottom face.

4. The fusing apparatus according to claim 1, wherein the second portion comprises an inner edge that outlines a second hole; and wherein the fixing member comprises a second engagement portion, the second engagement portion being fixed to the base member and engageable with the inner edges of the second hole.

5. The fusing apparatus according to claim 4, wherein the first engageable portion coincides with the second engageable portion to be engageable with the inner edges of both the first hole and the second hole; and wherein a peripheral portion around the second hole in the second portion of the sheet member is set in the recessed portion of the base member.

6. The fusing apparatus according to claim 5, wherein the base member is elongated along a longitudinal direction;

wherein the recessed portion is elongated along the longitudinal direction of the base member;

wherein the first portion of the sheet member comprises a plurality of inner edges, each of which outlines the first hole;

wherein each of the first holes is located at a position different from one another along the longitudinal direction;

wherein the first engagement portion of the fixing member includes a plurality of first engagement portions; and wherein each of the plurality of first engagement portions is engageable with a corresponding one of the plurality of inner edges, each of which outlines the first hole.

7. The fusing apparatus according to claim 6, further comprising a presser member elongated along the longitudinal direction, wherein the presser member pinches the first portion of the sheet member at a position between the inner face of the recessed portion and the presser member.

8. The fusing apparatus according to claim 1, wherein the base member is elongated along a longitudinal direction;

wherein the recessed portion is elongated along the longitudinal direction of the base member;

wherein the first portion of the sheet member comprises a plurality of inner edges, each of which outlines the first hole;

wherein each of the first holes is located at a position different from one another along the longitudinal direction;

wherein the first engagement portion of the fixing member includes a plurality of first engagement portions; and wherein each of the plurality of first engagement portions is engageable with a corresponding one of the plurality of inner edges, each of which outlines the first hole.

9. The fusing apparatus according to claim 1, wherein the fixing member includes at least one of a screw and a rivet.

10. A fusing apparatus, comprising:

a base member;

a sheet member wrapped around the base member; and an endless belt looped around the base member and the sheet member, the endless belt comprising an inner peripheral surface arranged to be in contact with the sheet member, wherein the sheet member comprises:

a contact portion comprising a contacting surface, on which the inner peripheral surface of the endless belt contacts the sheet member, and an opposite surface, which is on a side opposite to the contacting surface;

a first portion extending from a first end of the contact portion, the first portion comprising an inner edge that outlines a first hole; and a second portion extending from a second end of the contact portion, the second portion being fixed to the base member;

wherein the base member comprises:

a first face supporting the opposite surface of the contact portion of the sheet member;

a second face being a different face from the first face;

an inner face recessed from the second face to form a recessed portion, in which a peripheral portion around the first hole formed in the first portion of the sheet member is set; and the fixing portion fixing the sheet member to the base member; and wherein the fixing portion comprises:

a first engagement portion protruding from the inner face of the recessed portion of the base member, the first engagement portion being engageable with the inner edge of the first hole; and a holder provided at the first engagement portion, the holder being configured to hold the peripheral portion around the first hole in the first portion of the sheet member between the inner face of the recessed portion of the base member and the holder.

11. The fusing apparatus according to claim 10, wherein the second face of the base member is on a side opposite to the first face; and wherein the holder of the fixing portion is configured to pinch the peripheral portion around the first hole in the sheet member.

12. The fusing apparatus according to claim 10, wherein the inner face of the recessed portion of the base member comprises a bottom face and a side face connecting the bottom face with the second face;

wherein the side face inclines with respect to the second face; and wherein the first engagement portion protrudes from the bottom face.

13. The fusing apparatus according to claim 10, wherein the second portion comprises an inner edge that outlines a second hole; and wherein the fixing member comprises a second engagement portion, the second engagement portion being fixed to the base member and engageable with the inner edges of the second hole.

14. The fusing apparatus according to claim 13, wherein the first engageable portion coincides with the second engageable portion to be engageable with the inner edges of both the first hole and the second hole; and wherein a peripheral portion around the second hole in the second portion of the sheet member is set in the recessed portion of the base member.

15. The fusing apparatus according to claim 14, wherein the base member is elongated along a longitudinal direction;

wherein the recessed portion is elongated along the longitudinal direction of the base member;

wherein the first portion of the sheet member comprises a plurality of inner edges, each of which outlines the first hole;

wherein each of the first holes is located at a position different from one another along the longitudinal direction;

wherein the first engagement portion of the fixing portion includes a plurality of first engagement portions; and wherein each of the plurality of first engagement portions is engageable with a corresponding one of the plurality of inner edges, each of which outlines the first hole.

16. The fusing apparatus according to claim 15, further comprising:

a presser member elongated along the longitudinal direction, wherein the presser member pinches the first portion of the sheet member at a position between the inner face of the recessed portion and the presser member.

17. The fusing apparatus according to claim 10, wherein the base member is elongated along a longitudinal direction;

wherein the recessed portion is elongated along the longitudinal direction of the base member;

wherein the first portion of the sheet member comprises a plurality of inner edges, each of which outlines the first hole;

wherein each of the first holes is located at a position different from one another along the longitudinal direction;

wherein the first engagement portion of the fixing portion includes a plurality of first engagement portions; and wherein each of the plurality of first engagement portions is engageable with a corresponding one of the plurality of inner edges, each of which outlines the first hole.

18. The fusing apparatus according to claim 10, wherein the base member and the sheet member are assembled with each other by:

placing the first hole in the first portion of the sheet member at a position coincident with the first engagement portion; and plastically deforming a tip end of the first engagement portion to form the holder at the tip end of the first engagement portion and pushing the peripheral portion around the first hole in the sheet member into the recessed portion by the holder.

19. A fusing apparatus, comprising:

a base member;

a sheet member wrapped around the base member;

a fixing portion fixing the sheet member to the base member; and an endless member looped around the base member and the sheet member, the endless member comprising an inner peripheral surface arranged to be in contact with the sheet member, wherein the sheet member comprises:

a contact portion, on which the inner peripheral surface of the endless member contacts the sheet member;

a first portion extending from a first end of the contact portion, the first portion comprising an inner edge that outlines a first hole; and a second portion extending from a second end of the contact portion, the second portion being fixed to the base member;

wherein the base member comprises:

a first face supporting the contact portion of the sheet member;

a second face being a different face from the first face; and an inner face recessed from the second face to form a recessed portion, in which a peripheral portion around the first hole formed in the first portion of the sheet member is set; and wherein the fixing portion comprises:

a first engagement portion protrudes from the inner face of the recessed portion of the base member, the first engagement portion being engageable with the inner edge of the first hole; and a holder provided at the first engagement portion, the holder being configured to hold the peripheral portion around the first hole in the first portion of the sheet member between the inner face of the recessed portion of the base member and the holder.

20. The fixing apparatus according to claim 19, wherein the first engagement portion is formed integrally with the base member to extend from the inner face of the recessed portion.

* * * * *